US008893399B2

(12) United States Patent
Gregory et al.

(10) Patent No.: US 8,893,399 B2
(45) Date of Patent: Nov. 25, 2014

(54) LINT CATCHING SYSTEM

(71) Applicant: ADR Products, LLC, Laramie, WY (US)

(72) Inventors: David George Gregory, Laramie, WY (US); Adrienne Francesca Szabady, Laramie, WY (US)

(73) Assignee: ADR Products, LLC, Laramie, WY (US)

( * ) Notice: Subject to any disclaimer, the term of this patent is extended or adjusted under 35 U.S.C. 154(b) by 238 days.

(21) Appl. No.: 13/679,838

(22) Filed: Nov. 16, 2012

(65) Prior Publication Data

US 2013/0125410 A1 May 23, 2013

Related U.S. Application Data

(60) Provisional application No. 61/629,602, filed on Nov. 22, 2011.

(51) Int. Cl.

| | |
|---|---|
| ***F26B 11/02*** | (2006.01) |
| ***F26B 25/00*** | (2006.01) |
| ***D06F 58/20*** | (2006.01) |
| ***D06F 58/22*** | (2006.01) |

(52) U.S. Cl.

CPC ..... *F26B 25/007* (2013.01); *D06F 58/20* (2013.01); *D06F 58/22* (2013.01)

USPC ..... 34/82; 34/86; 34/381; 34/480; 68/5 C; 68/5 R; 8/149

(58) Field of Classification Search

USPC ..... 34/82, 86, 104, 105, 380, 381, 480; 68/5 C, 5 R, 19, 20; 8/137.1, 149, 159; 29/401.1

See application file for complete search history.

(56) References Cited

U.S. PATENT DOCUMENTS

| | | | | | |
|---|---|---|---|---|---|
| 1,521,262 | A | * | 12/1924 | Wainwright | 55/442 |
| 2,930,505 | A | * | 3/1960 | Meyer | 220/477 |
| 3,256,679 | A | * | 6/1966 | Snyder | 55/293 |
| 3,487,624 | A | | 1/1970 | Tignanelli | |
| 3,516,174 | A | * | 6/1970 | Behrens | 34/534 |
| 3,716,925 | A | * | 2/1973 | Hartung | 34/80 |
| 3,999,304 | A | | 12/1976 | Doty | |
| 4,121,351 | A | | 10/1978 | Kapke | |
| 4,137,647 | A | | 2/1979 | Clark, Jr. | |
| 4,338,731 | A | | 7/1982 | Shames et al. | |
| 4,395,831 | A | | 8/1983 | Nielsen | |

(Continued)

FOREIGN PATENT DOCUMENTS

| | | | | |
|---|---|---|---|---|
| DE | 3817849 | A1 | * | 12/1989 |
| EP | 2719810 | | * | 4/2014 |
| GB | 2300700 | A | * | 11/1996 |
| JP | 2004261324 | A | * | 9/2004 |

OTHER PUBLICATIONS

U.S. Appl. No. 61/629,602, filed Nov. 22, 2011.

(Continued)

*Primary Examiner* — Steve M Gravini

(74) *Attorney, Agent, or Firm* — Craig R. Miles; CR Miles, P.C.

(57) ABSTRACT

A lint catching system is provided for a clothes dryer. The lint catching system filters lint from exhaust air expelled from the clothes dryer.

18 Claims, 9 Drawing Sheets

(56) References Cited

U.S. PATENT DOCUMENTS

| | | | | |
|---|---|---|---|---|
| 4,434,564 | A | 3/1984 | Braggins, Jr. | |
| RE31,562 | E | 4/1984 | Bede | |
| 4,689,896 | A * | 9/1987 | Narang | 34/82 |
| 4,817,297 | A * | 4/1989 | Toma et al. | 34/595 |
| 4,890,396 | A * | 1/1990 | King | 34/235 |
| 5,210,960 | A * | 5/1993 | LaRue | 34/82 |
| 5,463,820 | A | 11/1995 | La Rue | |
| 5,628,122 | A * | 5/1997 | Spinardi | 34/79 |
| 5,675,908 | A | 10/1997 | Barnes | |
| 5,970,623 | A * | 10/1999 | Tuggle | 34/134 |
| 6,016,610 | A | 1/2000 | Sears | |
| 6,101,741 | A | 8/2000 | Sears | |
| 6,230,418 | B1 * | 5/2001 | Gomulinski | 34/140 |
| 6,550,157 | B1 * | 4/2003 | Harding | 34/140 |
| 6,709,499 | B2 | 3/2004 | Moschütz | |
| 6,966,126 | B2 | 11/2005 | Baurmann | |
| 6,971,186 | B1 | 12/2005 | Chin et al. | |
| 6,997,966 | B2 | 2/2006 | Iantorno | |
| 7,213,349 | B1 * | 5/2007 | Brunner | 34/86 |
| 7,497,030 | B2 | 3/2009 | Belgard | |
| 7,946,057 | B2 * | 5/2011 | Dittmer et al. | 34/603 |
| 8,240,064 | B2 * | 8/2012 | Steffens | 34/480 |
| 2002/0023368 | A1 * | 2/2002 | Beaumont | 34/79 |
| 2005/0252022 | A1 | 11/2005 | Tyau | |
| 2008/0022550 | A1 | 1/2008 | Masters | |
| 2010/0018071 | A1 | 1/2010 | McKinley | |
| 2013/0125410 | A1 * | 5/2013 | Gregory et al. | 34/82 |

OTHER PUBLICATIONS

FEMA. Clothes Dryer Fires in Residential Buildings. Topical Fire Research Series, Jan. 2007, vol. 7, Issue 1, pp. 1-6.

Lee, et al. Measurement of Developing Turbulent Flow in a U-Bend of Circular Cross-Section. Journal of Nechanical Science and Technology, 2007, vol. 21, No. 2, pp. 348-359.

* cited by examiner

LINT CATCHING SYSTEM

This U.S. Non-Provisional Patent Application claims the benefit of U.S. Provisional Patent Application No. 61/629,602, filed Nov. 22, 2011, hereby incorporated by reference herein.

I. FIELD OF THE INVENTION

A lint catching system for a clothes dryer. The lint catching system filters lint from exhaust air expelled from the clothes dryer.

II. BACKGROUND OF THE INVENTION

Conventional clothes dryers include a rotatable drum in which wet clothes are placed. During operation, the drum receives heated air which circulates through the drum as the drum rotates. The drying and tumbling of the clothes frees a large quantity of lint which is carried in the exhaust air. The dryer is equipped with a filter in the form of a mesh screen that receives the exhaust air from the drum. The mesh screen entraps a significant amount of the lint, nevertheless, the exhaust air still contains a substantial amount of lint.

The lint carried by the exhaust air includes textile fibers and other materials used in the manufacture of clothing, including naturally occurring fibers, such as cotton, wool, and linen, other non-naturally occurring fibers from materials such as SPANDEX, LYCRA, TYVEK which further accumulate with other fibers and particles such as human and animal hair, skin cells, plant fibers, pollen, dust, microorganisms, paper, tissue, or the like, which renders the exhaust air from the clothes dryer unsuitable for direct emission into an interior room of a commercial or residential building for a variety of reasons.

Inhalation of lint, as observed in early textile workers, may lead to diseases of the lungs, such as byssinosis or may exacerbate allergies and asthma, as well as, irritant the eyes. Microorganisms in lint can also be transferred to open wounds causing infection. Lint is also known to damage mechanical devices.

Unfortunately, conventional venting of the exhaust air external to the commercial or residential building to the atmosphere may not be possible due to internal or external space considerations, routing of conduit to the external vent may exceed manufacturer's recommendations, result in longer drying times, or create potential fire hazards. Accordingly, there may be no choice but to remove the lint from the exhaust air from the clothes dryer and vent the filter exhaust air from the clothes dryer to an interior room of the building. A number of solutions to remove lint from the exhaust air have been proposed; however, various disadvantages with the proposed solutions remain unresolved.

Certain proposed solutions, provide a conduit which receives the exhaust air from the clothes dry which has been filtered through the mesh screen and extends from the clothes dryer to a conduit outlet disposed in a container above a volume of liquid. During operation of the clothes dry, the exhaust air delivered from the conduit outlet is directed into the liquid where the lint is to be trapped. The twice-filtered air then exits the open end of the container into the interior room.

However, the exposure of the exhaust air to water increases the moisture level of the exhaust air increasing humidity in the interior room thus decreasing the efficiency of the drying cycle. Additionally, in cleaning the container the lint laden liquid cannot be disposed down a sink without the risk of drain clogging. If the water is not removed and cleaned at frequent intervals, the standing water becomes moldy, resulting in noxious odors and decreased sanitation levels in the interior room and in the air entering the drum. Additionally, if the water is allowed to evaporate, the filter will be rendered inoperable. Moreover, the surface area of the water that receives lint from the exhaust air is relatively small and, as a result, has a limited ability to entrain all lint that is directed towards the water.

Other proposed solutions provide a conduit which receives the exhaust air from the clothes dry which has been filtered through the mesh screen and extends from the clothes dryer to a conduit outlet coupled to a filter housing which supports a filtration material. The exhaust air travels through the filtration material. The twice-filtered air then exits filtration material into the interior room. However, the efficiency of a filter material in removing lint carried in the exhaust air from the clothes dryer can be dependent upon particular exhaust air flow characteristics developed within the filter housing supporting the filter material. Certain proposed constructional forms of the filter housing define an enclosed chamber having a volume in which the velocity of the exhaust air velocity is sufficiently reduced to allow lint or certain components of the lint to fall out of the exhaust air due to gravity or electrostatic forces to collect on the internal surfaces of the filter housing. If the filter housing is not cleaned at frequent intervals, the aggregated lint can further reduce exhaust air velocity exacerbating aggregation of lint on the internal surface of the filter housing. The aggregated lint can become moldy, resulting in noxious odors and decreased sanitation levels in the interior room and in the air entering the drum of the clothes dryer. As to other proposed constructional forms of the filter housing the exhaust air velocity in the enclosed chamber may be sufficient to maintain lint in the exhaust air to the filter material but the lint or components of the lint may not collect on the filter due to insufficient impact inertia. As to other proposed constructional forms of the filter housing the exhaust air velocity at the filter material may so greatly reduce the diffusion time of the lint or the lint components in the filter material that the lint or lint components pass through the filter material uncollected. As other proposed constructional forms of the filter housing, the exhaust air in the enclosed chamber may develop turbulence which affects the exhaust air velocity which is constant but varies over the surface or through the filter material, or which is variable in relation to any particular portion of the surface of the filter material. Accordingly, a filter material even when accorded a particular minimum efficiency reporting value ("MERV") may not collect lint or lint components in part or in whole, or perform worse than predicted based on the MERV because of various installation conditions related to the configuration of the filter housing and not the filter material itself.

There would be a substantial advantage in a lint catching system having a filter housing configured to address the disadvantages of the above proposed constructional forms of the filter housing in relation to the effect on the efficiency of the filter material.

III. SUMMARY OF THE INVENTION

Accordingly, a broad object of the invention can be to provide a clothes dryer and method of operating a dryer which includes a lint filter through which exhaust air flows prior to egress into the ambient environment. As to particular embodiments of the clothes dryer, the lint filter can include a filter housing configured to define a chamber having flat front panel wall and a flat back panel wall disposed in spaced apart relation connected by corresponding first and second side walls and first and second curved end panel walls each having 180 degree arc disposed in opposed outwardly extending relation. The filter housing further providing a housing inlet coupled to the first curved end panel wall and housing outlet disposed in the flat front panel wall configured to support a filtration material through which the exhaust air flows.

Another broad object of the invention can be to provide a clothes dryer and method of operating a dryer which includes a lint filter having a filter housing which defines an interior chamber which generates a circulation of the exhaust air laden with an amount of lint which can reduce deposition of lint from the exhaust air to the internal wall of the chamber, increase deposition of lint from the exhaust air to the filtration material, enhance laminar flow of the exhaust air within the chamber, enhance the uniformity of velocity of the exhaust air across the filtration material, and generate a velocity of the exhaust air in the chamber which increases approaching the filtration material.

Another broad object of the invention can be to provide a lint filter which can be retro-fitted to devices which produce exhaust air laden with an amount of lint, including but not limited to clothes dryer, through which exhaust air flows prior to egress into the ambient environment which as to particular embodiments allows exhaust air from such devices to be output into an interior building space.

IV. BRIEF DESCRIPTION OF THE DRAWINGS

V. DETAILED DESCRIPTION OF THE INVENTION

Figure 1:
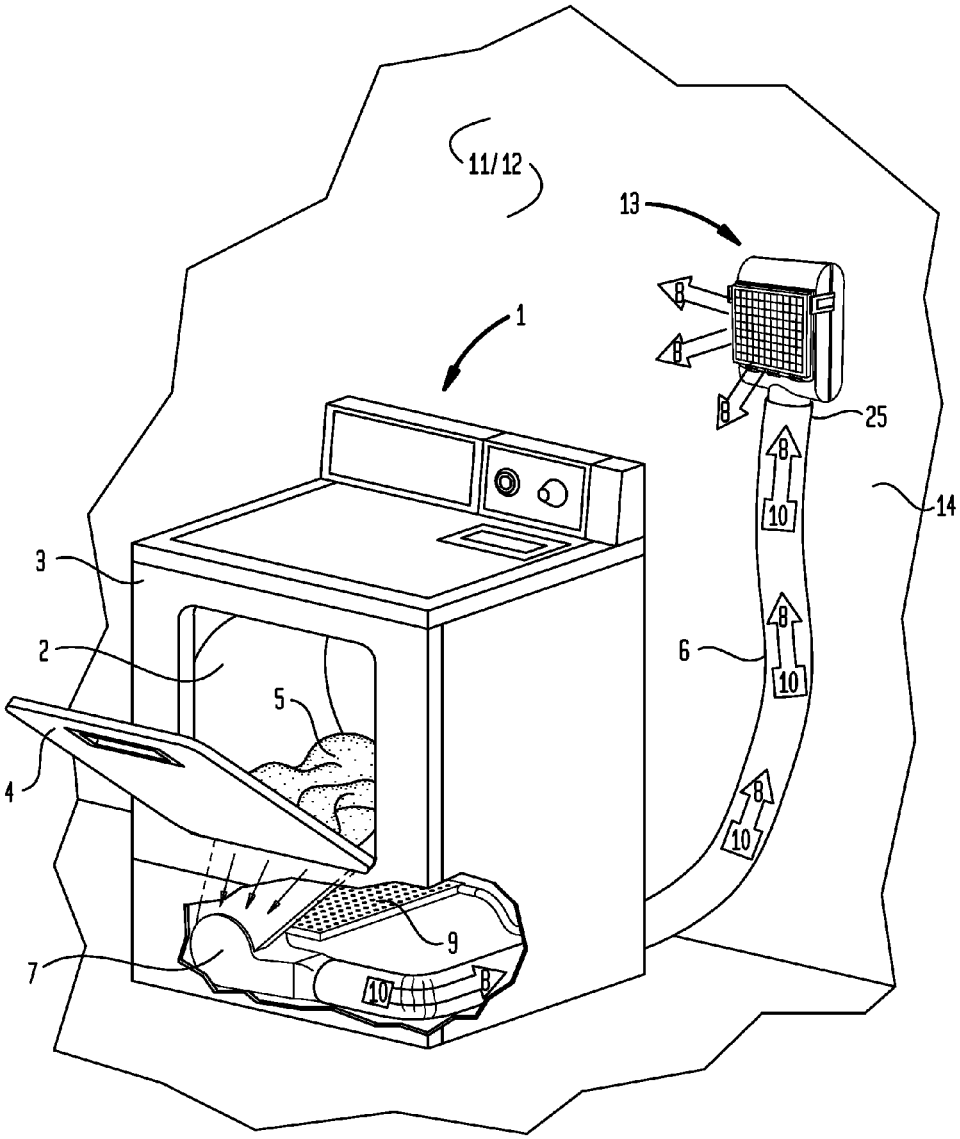
FIG. 1 is an illustration of a particular embodiment of the lint catching system for a clothes dryer.

Now referring primarily to FIG. 1, particular embodiments of the invention include a clothes dryer (1) having a rotatable drum (2) operationally disposed in a clothes dryer housing (3). A door (4) can be disposed in the clothes dryer housing (3) to allow access to the rotatable drum (2). Dryable material (5) can be introduced and removed from the rotatable drum (2) through the door (4). A conduit (6) can be coupled to the rotatable drum (2) and an air flow generator (7) disposed in the conduit (6) can move exhaust air (8) from the rotatable drum (2) through the conduit (6). A heating element (9) can be configured to heat air (10) flowing into the rotatable drum (2). The rotatable drum (2) containing dryable material (5) generates an exhaust air (8) which flows through the conduit (6) laden with an amount of lint (10).

The term "clothes dryer" for the purposes of this invention means any manner of device that moves exhaust air (8) laden with lint (10) requiring removal prior to being exhausted to an ambient environment (11), even though, particular embodiments of the instant invention are described with reference to a clothes dryer (1) of the type above described and illustrated in FIG. 1.

The term "ambient environment" for the purposes of this invention means the conditions characterizing the area, space, or atmosphere into which the exhaust air (8) is expelled and as examples can be the area, space, or atmosphere about the exterior of a building or an interior building space (12).

The term "dryable material" for the purposes of this invention means one or more materials from which water can be removed by engaging a flow of air including for example: clothing, bedding, towels, fabrics, or the like along with other materials collected on the dryable material (5) such as human and animal hair, skin cells, animal dander, insect parts, mold spores, dust mite droppings, pollen, dust, paper, tissue, or the like The term "lint" for the purposes of this invention means the one or more materials carried by the exhaust air (8) from a rotatable drum (2) operationally disposed in a clothes dryer housing (3). The one or more materials including for example: textile fibers and other materials used in the manufacture of clothing, such as cotton, wool, and linen, other non-naturally occurring fibers from materials such as SPANDEX, LYCRA, TYVEK, along with other materials collected on clothing such as human and animal hair, skin cells, animal dander, insect parts, mold spores, dust mite droppings, pollen, dust, paper, tissue, or the like.

Again referring primarily to FIG. 1 the exhaust air (8) laden with an amount of lint (10) can be delivered through a lint filter (13) in accordance with the invention prior to egress into the ambient environment (11) to remove the amount of lint (10) from the exhaust air (8). As to particular embodiments, the lint filter (13) can be a part of a clothes dryer (1), part of a kit to retrofit a clothes dryer (1), or be coupled to a conduit (6) through which exhaust air (8) laden with an amount of lint (10) flows from a clothes dryer (1), or other device. As to particular embodiments, the lint filter (13) can be mounted to a wall surface (14) of an interior building space (12) (as shown in the example of FIG. 1).

Figure 2:
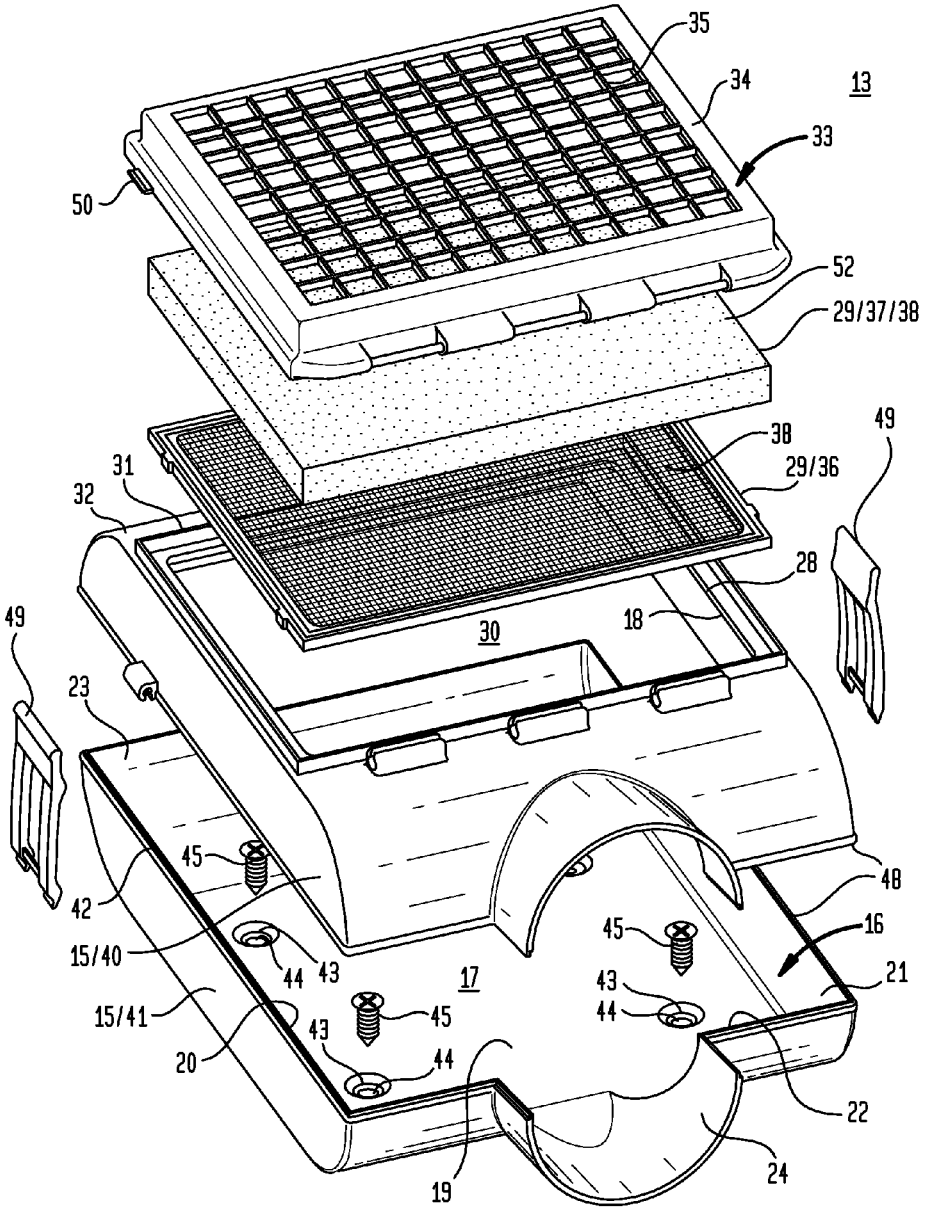
FIG. 2 is an exploded view of a particular embodiment of the inventive lint filter.
Figure 7:
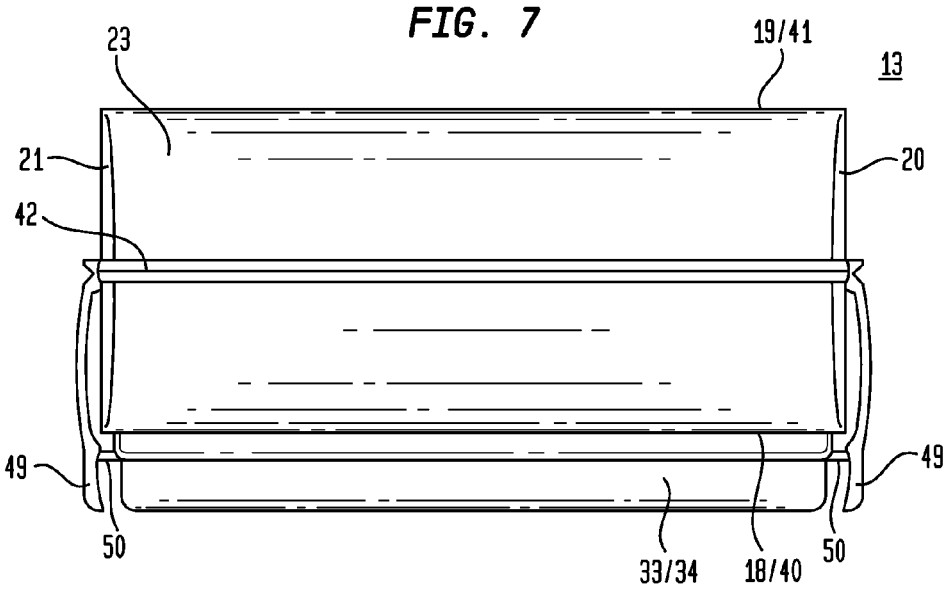
FIG. 7 is a first end view of a particular embodiment of the inventive lint filter.
Figure 8:
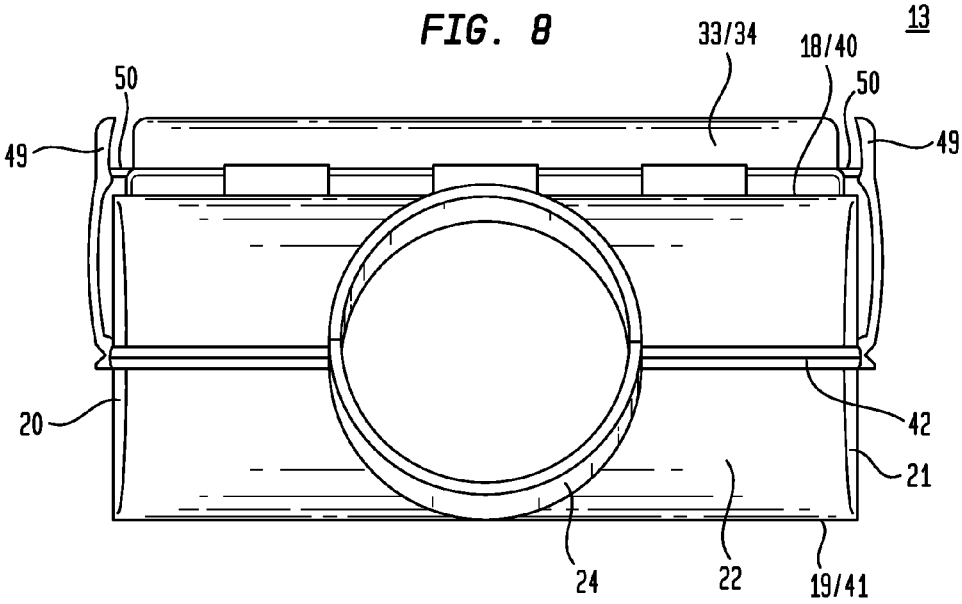
FIG. 8 is a second end view of a particular embodiment of the inventive lint filter.
Figure 9:
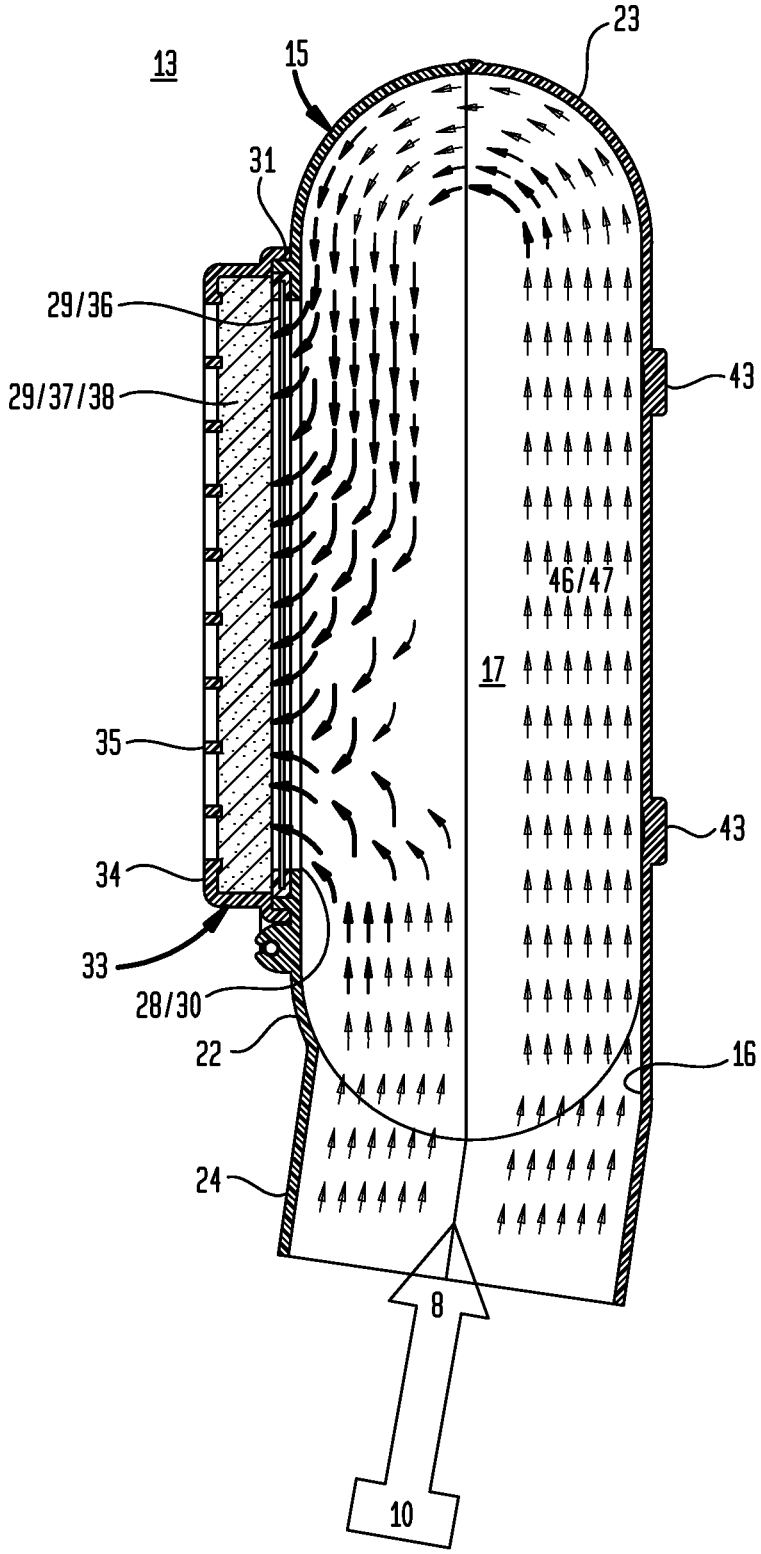
FIG. 9 is a cross section view 8-8 as shown in FIG. 3.
Figure 10:
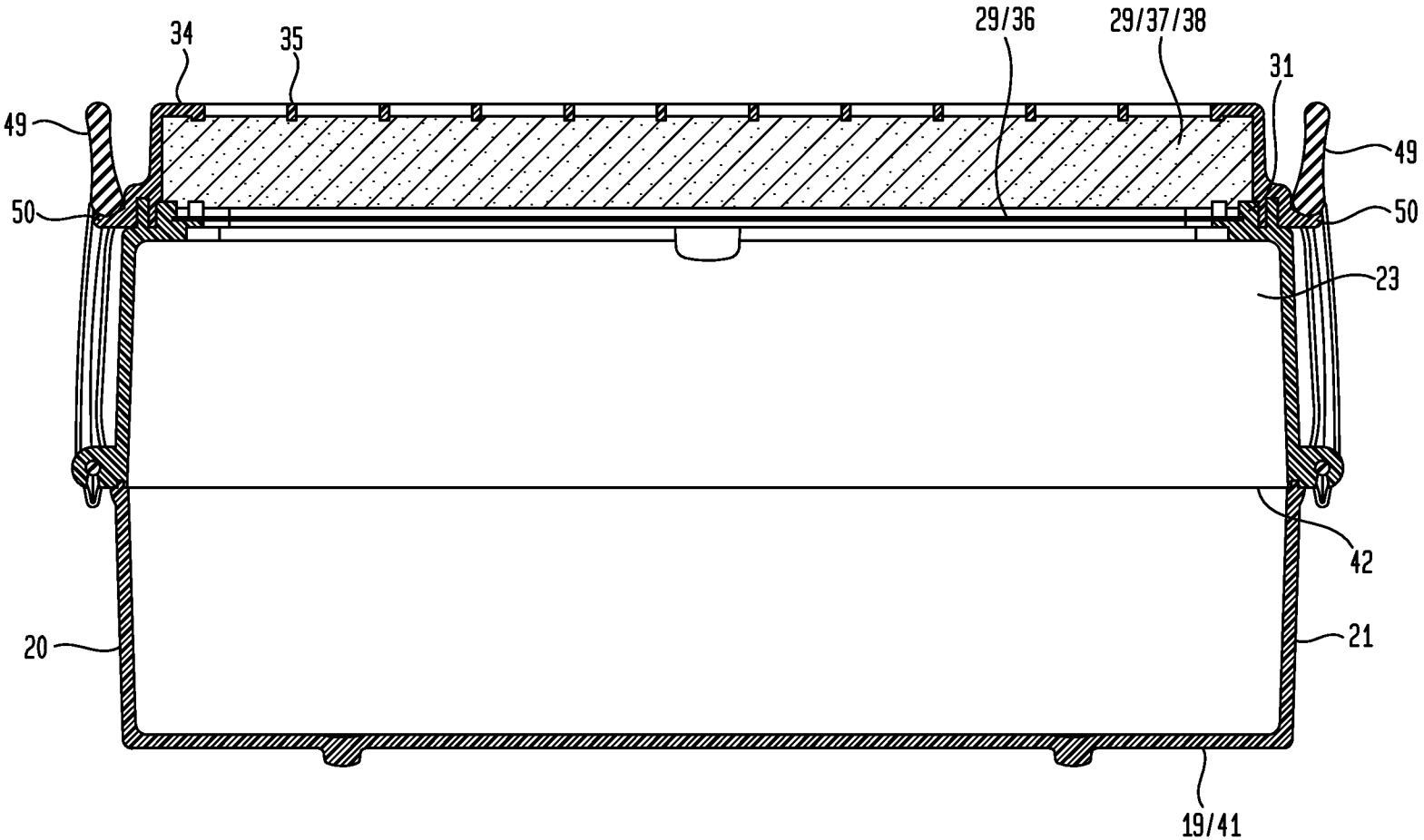
FIG. 10 is a cross section view 9-9 as shown in FIG. 5.

Now referring primarily to FIGS. 2 through 8, particular embodiments of the lint filter (13) includes a filter housing (15) having an internal wall (16) which defines an interior chamber (17) (as shown in the example of FIGS. 2 and 8). The internal wall (16) includes a flat front panel wall (18) and a flat back panel wall (19) disposed in spaced apart relation connected by a corresponding first side panel wall (20) and second side panel wall (21) and a first curved end panel wall (22) and a second curved end panel wall (23) each having a 180 degree arc disposed in opposed outwardly extending relation (as shown in the examples of FIGS. 2-7).

The term "flat" as used for the purposes of this invention means a substantially level or even surface which can include normal variation in fabrication or molding; and while particular embodiments of the invention are shown in the figures as having a flat front panel wall (18) and a flat back panel wall (19) disposed in substantially opposed parallel relation a distance apart (as shown in the example of FIG. 8), other embodiments may dispose the flat front panel wall (18) and flat back panel wall (19) in inwardly or outwardly inclined relation depending upon the application.

As to particular embodiments, the first side panel wall (20) and second side panel wall (21) can be substantially flat and disposed in opposed parallel relation (as shown in the example of FIG. 2); however, other embodiments may provide the first side panel wall (20) and second side panel wall (21) in outwardly or inwardly inclined relation, or may provide the first side panel wall (20) or the second side panel wall (21), or both, can have an amount of curvature.

Figure 3:
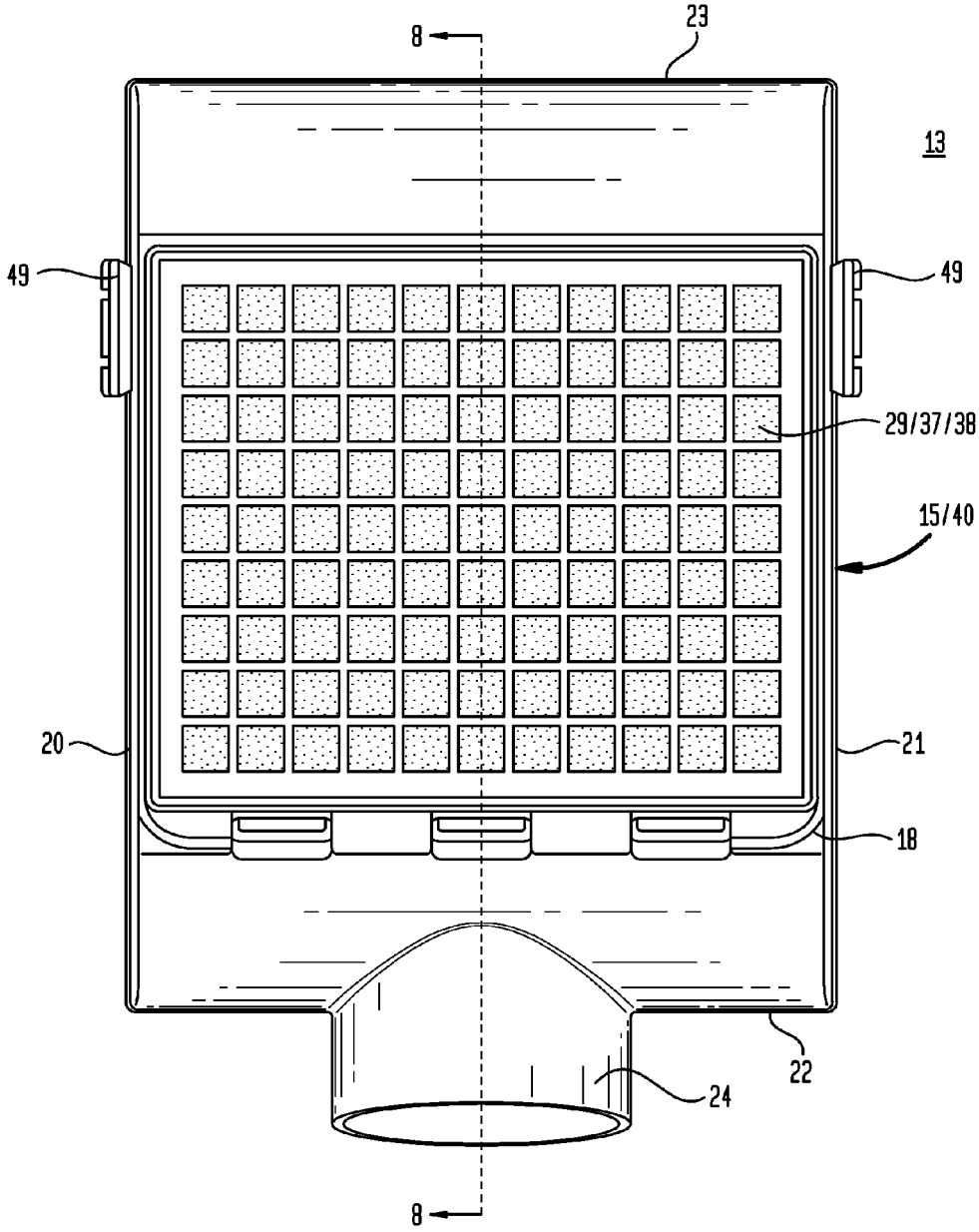
FIG. 3 is a top view of a particular embodiment of the inventive lint filter.
Figure 5:
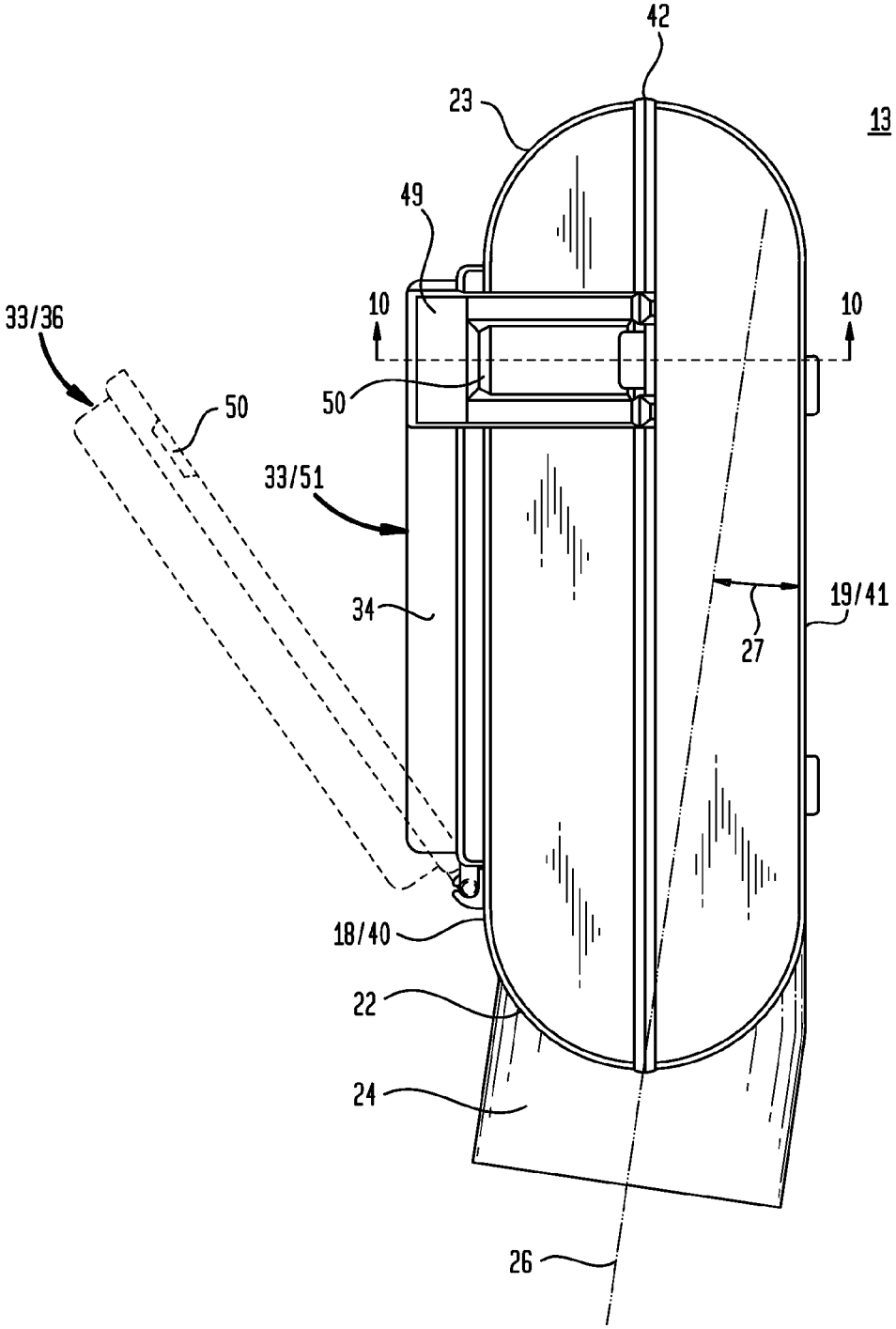
FIG. 5 is first side view of a particular embodiment of the inventive lint filter.
Figure 6:
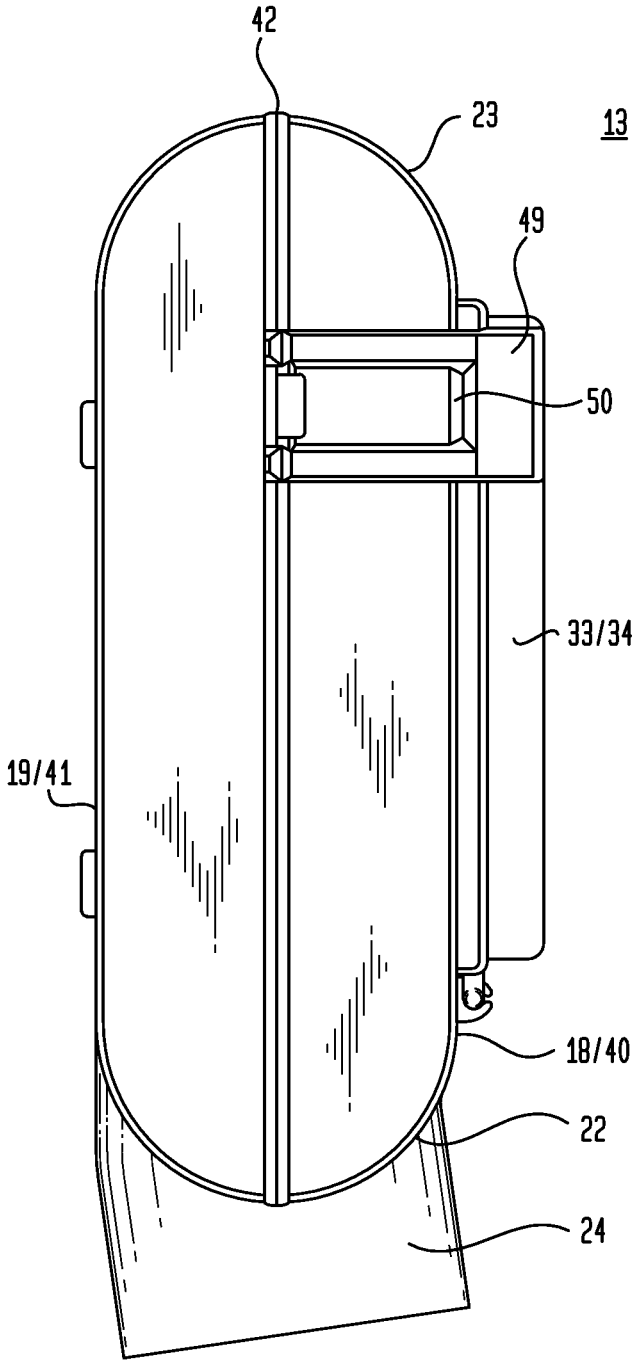
FIG. 6 is second side view of a particular embodiment of the inventive lint filter.

Now referring primarily to FIGS. 3, 5 and 7, particular embodiments of the invention can include a housing inlet (24) joined to the first curved end panel wall (22). The housing inlet (24) can be configured to couple or be retrofitted to an output end (25) of the conduit (6) coupled to the clothes dryer (2) to deliver the exhaust air (8) laden with lint (10) into the chamber (17) of the lint filter (13). As to particular embodiments, the housing inlet (24) can have a central longitudinal axis (26) which intersects the flat back panel wall (19) at an angle (27) of between about 5 degrees and about 15 degrees.

Now referring primarily to FIGS. 2, 3 and 8, particular embodiments of the invention can include a housing outlet (28) disposed in the flat front panel wall (18) configured to support a filtration material (29) through which exhaust air (8) egresses from the chamber (17) of the lint filter (13). The housing outlet (28) defines an aperture (30) disposed in the flat front panel wall (18) of the filter housing (15) (as shown in the examples of FIGS. 2 and 8). A bezel (31) can surround the aperture (30) and outwardly extend from the external surface (32) of the flat front panel wall (18). The filtration material (29) can be supported within the bezel (31) to engage the external surface (32) of the flat front panel wall (18) (as shown in the example of FIG. 2). A filter retainer (33) including a retainer frame (34) configured to removably sealably engage the bezel (31), and a retainer screen (35) coupled within the retainer frame (34) can be configured to engage the filter material (29). As to particular embodiments, the filter retainer (33) can be rotatably coupled to the front panel wall (18) to operate from an open condition (36) (as shown in the example of FIG. 5 in broken line) which allows the filtration material (29) to be inserted within and removed from the bezel (31) and a closed condition (51) (as shown in the example of FIG. 8) which retains the filtration material within the bezel (31). The filtration material (29) retained within the bezel (31) sufficiently sealably engages the filtration material edges (52) to direct the exhaust air (8) laden with lint (10) through the filtration material (29). The filtration material (29) can sequester substantially all of the lint (10) in the flow of exhaust air (8). One or more latches (49) pivotally engaged to the external surface of the filter housing (15) can operate to rotatingly latchably engage and disengage from corresponding latch members (50) which extend outwardly from the retainer frame (34).

Now referring primarily to FIGS. 2 and 8, particular embodiments of the invention can provide a filtration material (29) having a "minimum efficiency reporting value" ("MERV") of between about 4 and about 8. The term "minimum efficiency reporting value" or "MERV" for the purposes of this invention means the rating of an air cleaner according to standards set by the ANSI/ASHRAE Standard 52.2-1999. Under the Standard, air cleaners are given MERV ratings based on the results of a series of tests in which test particles are introduced into the air of the testing area. The test particles based on size fall into one of twelve size categories. The smallest particles range from 0.3 to 0.4 micrometers and the largest particles range from 7 to 10 micrometers. The air is then passed through the filter being tested. The density of particles in the air is measured before and after the air passes through the filter to determine how effective the filter is at removing the test particles in each size category. A filtration material (29) having a MERV of between 4 and 8 can effectively remove lint (10) (and particles which may be components of the lint (10)) from exhaust air (8) from a clothes dryer (1), or other device that generates exhaust air (8) laden with lint (10), even in the range of 3 micrometers and 10 micrometers, such as: mold spores, dust mite body parts and droppings, cat and dog dander, hair spray, dusting aids, pudding mix, and other similar sized particles.

As shown in FIG. 2, as to particular embodiments, the filtration material (29) supported within the bezel (31) can comprise a first filter (36) and a second filter (37). The first filter (36) can comprise a mesh element (38) having open area of between about 50 percent and about 70 percent which supportingly engages the second filter (37) having a MERV of between 4 and 8. As an illustrative example, the first filter (36) can comprise a screen having a mesh of between about 24 and about 28 mesh depending on the diameter of the wire to provide an opening of between about 0.0275 inches and about 0.032 inches, and the second filter (37) can comprise a paint arrestor polyester media filter (38) having a thickness of between about one-half inch and about one inch having MERV 5.

Figure 4:
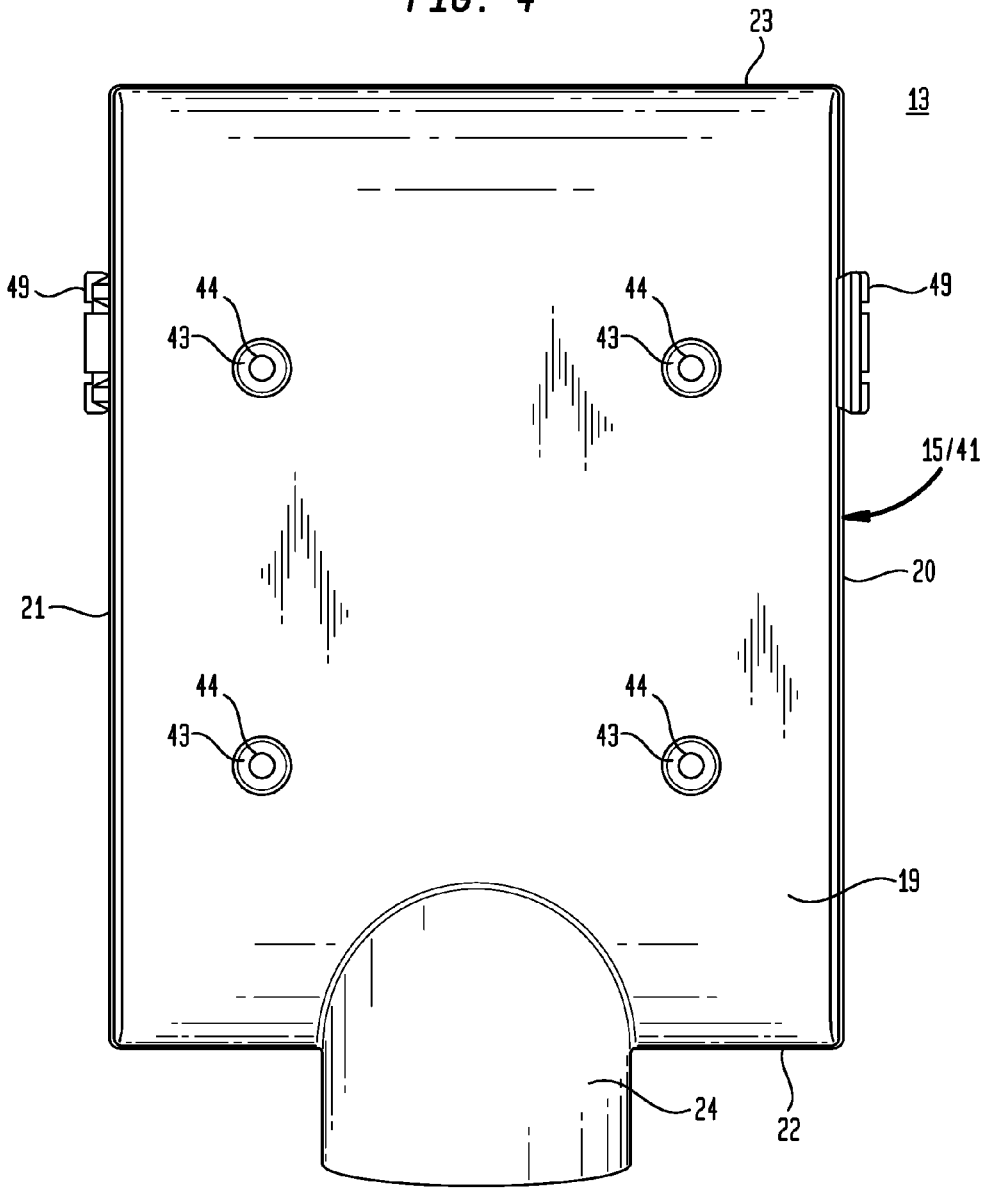
FIG. 4 is bottom view of a particular embodiment of the inventive lint filter.

Now referring primarily to FIG. 2, particular embodiments of the filter housing (15) can include a front filter housing (40) which removably sealably joins a back filter housing (41) at a juncture plane (42) which generally bisects each of the first curved end panel wall (22) and the second curved end panel wall (23) at about 90 degrees of arc (as shown in the example of FIG. 8). The back filter housing (41) can further include one or more lint filter mount elements (43) configured to allow the lint filter (13) to be mounted to a vertical wall surface (14). The embodiment of the lint filter (13) shown in FIGS. 2 and 4, provides the lint filter mount elements (43) as being a recess having a central bore (44) which communicates between the internal wall (16) and the external wall (32) of the back filter housing (41) through which a mechanical fastener (45) can pass to secure the back filter housing (41) to a wall surface (14). As to particular embodiments, the front filter housing (40) and the back filter housing (41) can each provide a removably matable whole or half tongue and groove (48).

Now referring primarily to FIG. 8, as to particular embodiments, the exhaust air (8) laden with an amount of lint (10) can be delivered into the chamber (17) of the lint filter (13) through the housing inlet (24) disposed in the first curved end panel wall (22) and directed toward the second curved end panel wall (23). The first and second curved end panel walls (22) (23) can generate an advantageous circulation pattern (46) of the exhaust air (8) inside the chamber (17) which acts to retain, or increase retention, of the amount of lint (10) in the exhaust air (8) between the housing inlet (24) and the housing outlet (28) of the air filter (13). Additionally, the advantageous circulation pattern (46) of the exhaust air (8) inside the chamber (17) acts to deposit the amount of lint (10) retained in the exhaust air (8) onto or into the filtration material (29) supported in bezel (31) of the housing outlet (28).

Based on the contours of the internal wall (16) of the of the filter housing (15), above described, the circulation pattern (46) within the chamber (17) (as represented by the arrows in the example of FIG. 8) can increase, maintain, or reduce loss of laminar flow (47) of the exhaust air (8) between the housing inlet (24) and the housing outlet (28). The term "laminar flow" for the purposes of this invention means exhaust air flow (8) which travels smoothly or in regular paths within the chamber (17) such that exhaust air (8) has substantially constant flow at each point in the chamber (18) as to velocity, pressure and other flow properties. An advantage of achieving enhanced laminar flow (47) can be the reduction in eddies or turbulences which can force an amount of lint (10) out of the exhaust air (8) to deposit on the internal wall (16) of the chamber (17).

As to particular embodiments, based on these contours, the velocity of the exhaust air (8) can be substantially uniform over and through the filtration material (29) (as shown in the example of FIG. 8 arrows representing exhaust air (8) laden with lint (10) having substantially uniform weight at surface of filtration material (29)). Additionally, the exhaust air (8) can achieve, maintain, reduce loss, or even increase acceleration within the curve of the second curved end panel wall (23) and near the internal wall (16) downstream of the second curved end panel wall (23) approaching the housing outlet (24) (increasing velocity indicated by increasing size and weight of arrows as shown in the example of FIG. 8). This maintenance, reduced loss or increased velocity assists in retention of the amount of lint (10) within the exhaust air (8) and can produce advantageous forces of impact of the amount of lint (10) with the filtration material (29). In this regard, the velocity of the amount of lint (10) (or lint components) directed by the contours as described can be sufficient to allow impact at sufficient force to be captured by the filter material (29) but at impact forces which are insufficient to drive the amount of lint (10) through the filtration material (29) into the ambient environment (11).

As can be easily understood from the foregoing, the basic concepts of the present invention may be embodied in a variety of ways. The invention involves numerous and varied embodiments of a lint catching system and methods for making and using such lint catching system including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "filter" should be understood to encompass disclosure of the act of "filtering"—whether explicitly discussed or not—and, conversely, were there effectively disclosure of the act of "filtering", such a disclosure should be understood to encompass disclosure of a "filter" and even a "means for filtering." Such alternative terms for each element or step are to be understood to be explicitly included in the description.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the lint catching systems or lint catching devices herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A kit to retrofit a clothes dryer which delivers an exhaust air laden with an amount of lint through an output end of a conduit into an ambient environment, said kit comprising:

a) a lint filter having a filter housing having a flat front panel wall and a flat back panel wall disposed in spaced apart relation connected by corresponding first and second side walls and first and second curved end panel walls disposed in opposed outwardly extending relation each having 180 degree arc;

b) a housing inlet coupled to said first curved end panel, said housing inlet configured to couple to said output end of said conduit to deliver said exhaust air into lint filter toward said second curved end wall; and c) a housing outlet disposed in said flat front panel wall configured to support a filtration material through which said exhaust air flows to egress from said chamber of said filter housing.

2. The kit of claim 1, wherein said filtration material has a MERV of between about 5 and about 8.

3. The kit of claim 1, wherein said housing inlet has a central longitudinal axis which intersects said flat back panel wall at an angle of between about 5 degrees and about 15 degrees.

4. The kit of claim 1, wherein said housing outlet defines an aperture disposed in said flat front panel of filter housing, said aperture surrounded by a bezel which extends outwardly from said flat front panel wall, said filtration material supported on the external surface of said flat front panel wall within said bezel.

5. The kit of claim 4, further comprising a filter retainer including a retainer frame configured to removably sealably engage said bezel, and a retainer screen coupled within said retainer frame configured to engage said filter material.

6. The kit of claim 5, wherein said filtration material comprises a first filter engaged to a second filter, said first filter comprising a mesh having open area of between about 50 percent and about 70 percent, said second filter having a MERV of between about 5 and about 8.

7. The kit of claim 6, wherein said second filtration material comprises a polyester media filter.

8. The kit of claim 1, wherein said filter housing comprises a front filter housing which removably sealably joins to a back filter housing.

9. The kit of claim 8, wherein said front filter housing removably sealably joins said back filter housing at a juncture plane which generally bisects each of said first curved end wall and said second curved end wall at about 90 degrees of arc.

10. A method of retrofitting a clothes dryer delivering an exhaust air laden with an amount of lint through an output end of a conduit to the ambient environment, comprising:

a) obtaining a lint filter having a filter housing having a flat front panel wall and a flat back panel wall disposed in spaced apart relation connected by corresponding first and second side walls and first and second curved end panel walls disposed in opposed outwardly extending relation, said first and second curved end panel walls each having a 180 degree arc disposed in opposed outwardly extending relation, said housing inlet configured to couple to said output end of said conduit to deliver said exhaust air into said lint filter toward said second curved end wall, and a housing outlet disposed in said flat front panel wall configured to support a filtration material through which said exhaust air flows to egress from said chamber of said filter housing; and b) coupling said housing inlet to said output end of said conduit.

11. The method of claim 10, wherein said housing inlet has a central longitudinal axis which intersects said flat back panel wall at an angle of between about 5 degrees and about 15 degrees.

12. The method of claim 11, wherein said housing outlet defines an aperture disposed in said flat front panel of filter housing, said aperture surrounded by a bezel which extends outwardly from said flat front panel wall, said filtration material supported on the external surface of said flat front panel wall within said bezel.

13. The method of claim 12, further comprising sealably engaging a filter retainer to said bezel to retain said filter material within said bezel.

14. The method of claim 13, wherein said filtration material has a MERV of between about 5 and about 8.

15. The method of claim 14, wherein said filtration material comprises a first filter and a second filter, said first filter comprising a mesh having open area of greater than 50 percent, said second filter having a MERV of between about 5 and about 8.

16. The method of claim 15, wherein said second filtration material comprises a polyester media filter.

17. The method of claim 16, further comprising removably sealably joining a front filter housing to a back filter housing to provide said filter housing.

18. The method of claim 17, wherein said first filter housing removably sealably joins said second filter housing at a juncture plane which generally bisects each of said first curved end and said second curved end at about 90 degrees of arc.

* * * * *